US009343257B2

(12) United States Patent
Baek

(10) Patent No.: US 9,343,257 B2
(45) Date of Patent: May 17, 2016

(54) CIRCUIT BREAKER WITH A MAGNET FIXING MEANS

(71) Applicant: LSIS CO., LTD., Anyang-si, Gyeonggi-do (KR)

(72) Inventor: Ki Ho Baek, Cheongju-si (KR)

(73) Assignee: LSIS CO., LTD., Anyang-si (KR)

( * ) Notice: Subject to any disclaimer, the term of this patent is extended or adjusted under 35 U.S.C. 154(b) by 305 days.

(21) Appl. No.: 14/029,099

(22) Filed: Sep. 17, 2013

(65) Prior Publication Data

US 2015/0077211 A1 Mar. 19, 2015

(51) Int. Cl.

| | |
|---|---|
| ***H01H 37/52*** | (2006.01) |
| ***H01H 37/04*** | (2006.01) |
| ***H01H 71/32*** | (2006.01) |
| ***H01H 71/16*** | (2006.01) |

(52) U.S. Cl.

CPC ..... *H01H 71/325* (2013.01); *H01H 71/164* (2013.01); *H01H 2071/168* (2013.01)

(58) Field of Classification Search

CPC ..... H01H 71/164; H01H 71/325; H01H 2071/168

USPC ..... 337/3, 13, 54, 90, 98, 102, 107, 112

See application file for complete search history.

(56) References Cited

U.S. PATENT DOCUMENTS 3,116,388 A * 12/1963 Hobson, Jr. ..... H01H 83/20 335/173
3,345,591 A 10/1967 Leonard et al.
4,630,019 A * 12/1986 Maier ..... H01H 71/7436 335/45
5,859,578 A * 1/1999 Arnold ..... H01H 71/121 337/110
6,633,211 B1 * 10/2003 Zindler ..... H01H 71/7463 335/35
7,250,836 B2 * 7/2007 Fleege ..... H01H 71/08 335/202
7,518,482 B2 * 4/2009 Fleege ..... H01H 71/16 337/36
2004/0070483 A1 * 4/2004 Richter ..... H01H 71/164 337/23
2009/0295532 A1 12/2009 Puhalla et al.

FOREIGN PATENT DOCUMENTS

KR 10-2004-0070544 8/2004
KR 2013/126061 8/2013

OTHER PUBLICATIONS

Korean Intellectual Property Office Application Serial No. 20-2012-007230, Office Action dated Aug. 27, 2013, 3 pages.
European Patent Office Application Serial No. 13184775.8, Search Report dated Jan. 29, 2014, 7 pages.

* cited by examiner

*Primary Examiner* — Anatoly Vortman
(74) *Attorney, Agent, or Firm* — Lee, Hong, Degerman, Kang & Waimey; Jonathan Kang; Richard Salfelder

(57) ABSTRACT

The present invention provides a magnet fixing means having a circuit breaker including a heater generating heat due to a conduction current induced to a moving contact of the circuit breaker; a bimetal deformed due to heat generated by the heater to separate a contact point of the moving contact; a magnet generating a magnetic force to move an armature bar when a current above a previously set reference current is induced; a trip case accommodating the bimetal and magnet, at least part of which is made of a synthetic resin material; a magnet fixing portion integrally formed in the trip case, and made of a synthetic resin material; a magnet fixing means fastening the magnet to the magnet fixing portion; and a bimetal fixing means fixing the bimetal to the heater, where a magnet-side separating gap exists between the magnet and the heater such that the heater does not contact the magnet.

7 Claims, 4 Drawing Sheets

CIRCUIT BREAKER WITH A MAGNET FIXING MEANS

BACKGROUND OF THE INVENTION

1. Field of the Invention

The present invention is directed to a circuit breaker with a magnet fixing means, and more particularly, to a circuit breaker with a magnet fixing means for fixing a magnet used to break an overcurrent that occurs.

2. Description of the Related Art

In general, a circuit breaker is an electrical device provided within a distribution switchboard having a low voltage circuit (15-30 A) with AC 110/220V to be used for the purpose of preventing electric shock on human body, a fire caused by a short circuit, an accident due to an overcurrent and a short circuit, and the like.

Such a circuit breaker, as a device for sensing a fault current when the fault current and short-circuit current occur and breaking a line to protect the load and line connected thereto, is widely used in the related art instead of one combined with a knife switch and a fuse since it is small-sized and safely manipulated as well as has no trouble in inserting a fuse.

The fault current sensing function of the circuit breaker may include an overcurrent protection function and an instantaneous current protection function, and the overcurrent protection function performs a trip operation using a heater and a bimetal provided within the breaker by allowing the bimetal to be bent, and the instantaneous current protection function performs a trip operation using a magnet magnetized by an instantaneously generated high current.

According to the use of a circuit breaker, the size and conduction time of current is variably set at which a trip operation should be carried out, and in case of a thermal electronic circuit breaker having the foregoing structure, it is set not to perform a trip operation when the current flows below 105% of rated current, but set to perform a trip operation above 130% of rated current. Furthermore, when the current flows above 105% and below 130%, a time for starting the trip operation is individually set according to the size of current.

FIG. 1 is a cross-sectional view illustrating the internal structure of a typical circuit breaker. Referring to FIG. 1, the foregoing bimetal 10, heater 11, and magnet 12 are fastened by one fixing bolt. The heater 11 generates heat due to its induced current, and the generated heat is conducted into the bimetal 10. When an overcurrent flows, enough heat to deform the bimetal 10 is generated, thereby breaking the conduction of the overcurrent. Meanwhile, in describing the instantaneous current protection function, when a current above the reference current instantaneously flows, the magnet 12 is magnetized to pull an armature bar 13 disposed at the right side (with respect to FIG. 1) of the magnet 12 to the side of the magnet 12 to perform a trip operation.

In the foregoing structure, heat generated by the heater while an overcurrent flows is conducted to the side of the magnet along the fixing bolt as well as the bimetal. Due to this, an amount of heat conducted to the bimetal is reduced, thereby causing a problem that the operation of the bimetal is inaccurate. Due to this, an amount of heat transferred to the side of the bimetal should be taken into consideration during the design of a circuit breaker, thereby causing a problem that the design of the circuit breaker becomes difficult. Furthermore, the amount of conducted heat varies according to the abrasion degree of the fixing bolt and the difference of the fastening force, and as a result, there exists a problem that the operational characteristics of the circuit breaker become inconsistent.

SUMMARY OF THE INVENTION

The present invention overcomes the foregoing problems in the related art and by providing a circuit breaker capable of constantly maintaining its operational characteristics.

The present invention further provides a circuit breaker capable of allowing a bimetal to be accurately operated according to regulations such as a conduction time, a conduction current value, and the like.

According to an aspect of the present invention, a circuit breaker is provided that includes a heater configured to generate heat due to a conduction current induced to a moving contact of the circuit breaker; a bimetal configured to be deformed due to heat generated by the heater to separate a contact point of the moving contact; a magnet configured to generate a magnetic force to move an armature bar when a current above a previously set reference current is induced; a trip case configured to accommodate the bimetal and magnet, at least part of which is made of a synthetic resin material, a magnet fixing portion integrally formed in the trip case, and made of a synthetic resin material; a magnet fixing means configured to fasten the magnet to the magnet fixing portion; and a bimetal fixing means configured to fix the bimetal to the heater, where a magnet-side separating gap exists between the magnet and the heater such that the heater is not brought into contact with the magnet.

The circuit breaker may further include a heater fixing means configured to fix the heater to the trip case, where the heater fixing means is fastened to the magnet fixing portion.

Furthermore, a bimetal-side separating gap may be disposed between the heater and the bimetal. The two separating gaps may be respectively disposed on the remaining portion excluding the contact portion.

Furthermore, only one side end portion of the magnet may be fixed to the magnet fixing portion. Further, the magnet may be spaced apart from the trip case except the end portion fixed to the magnet fixing portion.

Furthermore, an interference avoidance portion for accommodating part of the magnet fixing means may be formed at the heater.

According to aspects of the present invention, a heater and a magnet may be separated from each other and individually fastened, thereby minimizing an amount of heat transferred from the heater to the magnet, and accordingly, constantly maintaining the operational characteristics of a bimetal. In particular, the magnet may be fastened to a magnet fixing portion made of a synthetic resin material having a low thermal conductivity, and a magnet-side separating gap may be disposed between the heater and the magnet, thereby further minimizing the amount of heat conducted from the heater.

Moreover, a bimetal-side separating gap may be also provided between the heater and the bimetal, thereby minimizing the deformation and positional discrepancy and the like of the bimetal due to the expansion of the heater.

Furthermore, only one side end portion of the magnet may be fastened to the magnet fixing portion, thereby minimizing a thermal conduction path connected from the heater to the magnet.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
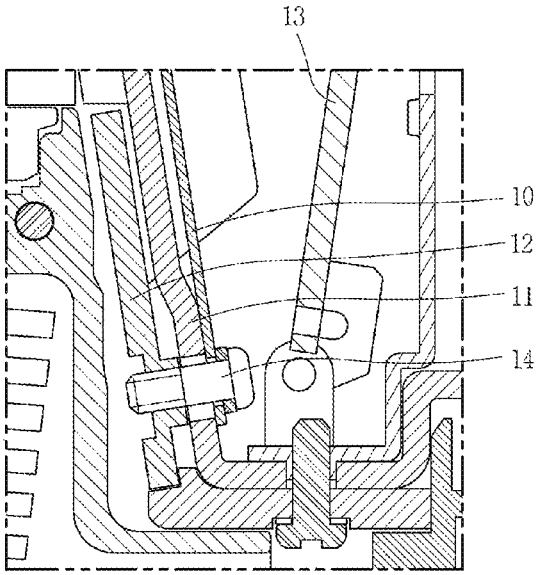
FIG. 1 Prior Art
FIG. 1 is a schematic diagram illustrating the internal structure of a circuit breaker according to the related art.

Hereinafter, a circuit breaker according to an embodiment of the present disclosure will be described in detail with reference to the accompanying drawings.

It should be noted that terms and words used in the description and claims must not be limited and interpreted to be typical or literal, and should be construed as the meaning and concept conforming to the technical concept of the invention on the basis that the inventor can define the concept of the terms and words to describe the invention in a best way.

Since the described embodiments and configurations shown in the drawings are the preferred embodiments only and do not represent all the technical concepts of the invention, it should be understood that there may be various equivalents and modification examples that may replace them at the time of application of present invention.

Figure 2:
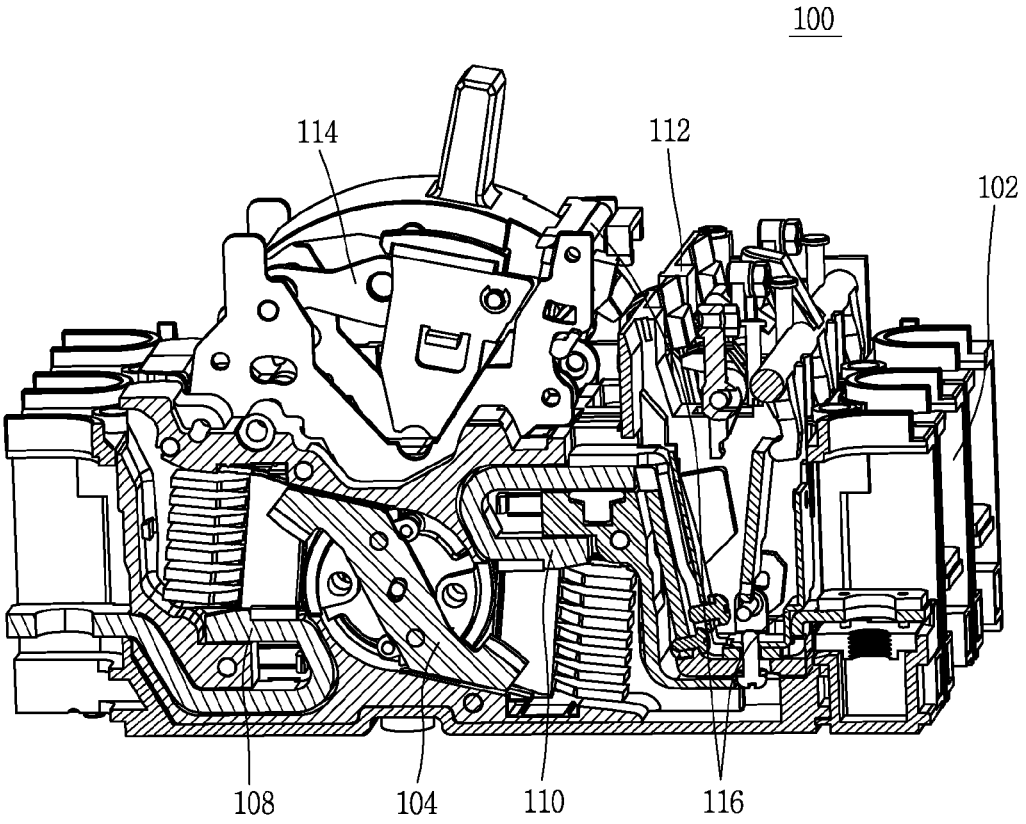
FIG. 2 is a partial cross-sectional view illustrating the internal structure of a circuit breaker according to an embodiment of the present disclosure.
Figure 3:
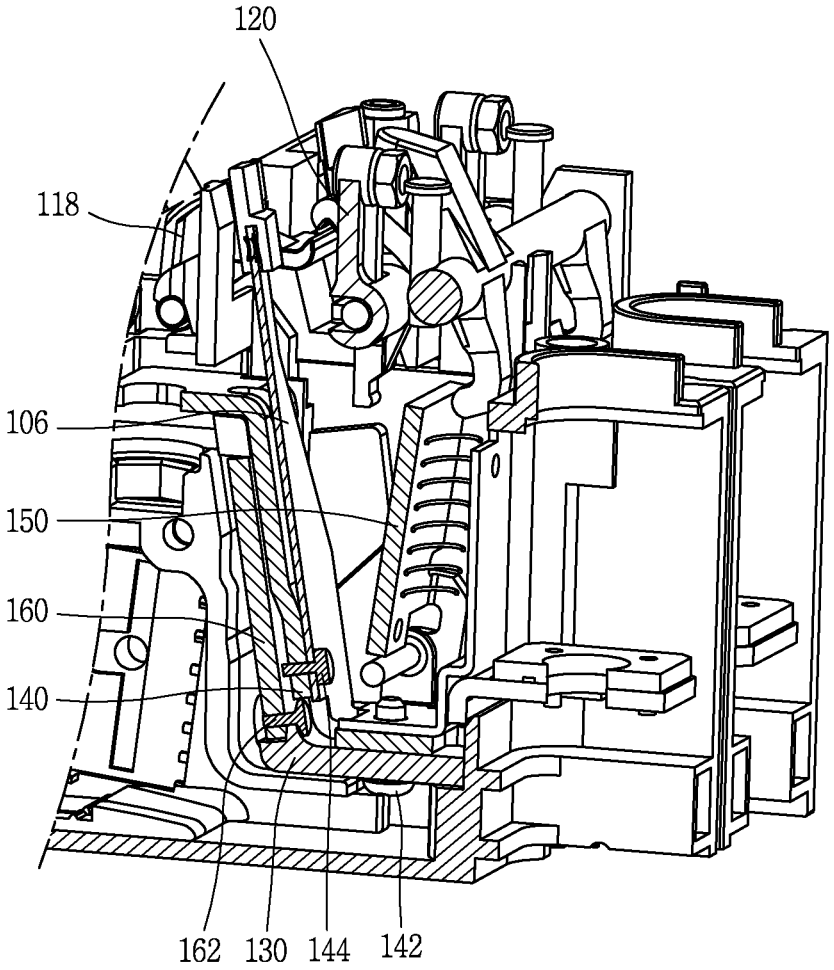
FIG. 3 is an enlarged partial cross-sectional view illustrating part of the embodiment illustrated in FIG. 2.

FIG. 2 is a partial cross-sectional view illustrating the internal structure of a circuit breaker according to an embodiment of the present invention, and FIG. 3 is an enlarged partial cross-sectional view illustrating part of the embodiment illustrated in FIG. 2. Referring to FIGS. 2 and 3, the embodiment 100 may include a case 102 on which a switch is rotatably provided to selectively switch a current supplied from the power side to the load side, a moving contact 104 rotatably provided within the case 102, on an end portion of which there is provided a contact point of the current, and a bimetal 106 connected to the moving contact 104 through a lead line.

The case 102 is an injection molded part made of a synthetic resin material, which functions as an enclosure of the circuit breaker.

A first fixed contact 108 formed of a conductive material to be fixed to the case, which is a power-side stationary contact point, and a second fixed contact 110, which is a load-side stationary contact point, are provided within the case 102. A gap between the first fixed contact and the second fixed contact is electrically connected or disconnected while rotating the moving contact 104, and FIG. 2 illustrates a state in which the moving contact is not brought into contact with the first and the second fix contact, namely, a disconnecting state.

A trip assembly 112 configured to actuate the moving contact 104 and a driving mechanism 114 mechanically connected to the trip assembly to drive the trip assembly are additionally provided within the case 102.

Furthermore, the driving mechanism 114 may include a plurality of nails 116 mechanically connected to the trip assembly 112.

Referring to FIG. 3, the trip assembly 112 may include a rotatably fixed shooter 118, and the shooter 118 transfers power between the nail 116 and a crossbar 120.

On the other hand, a magnet fixing portion 130 is provided within the case 102 as an integral or individual element with the case 102. The magnet fixing portion 130 is made of a synthetic resin material, and part of an element contained in the trip assembly 112 is fixed thereto.

Figure 4:
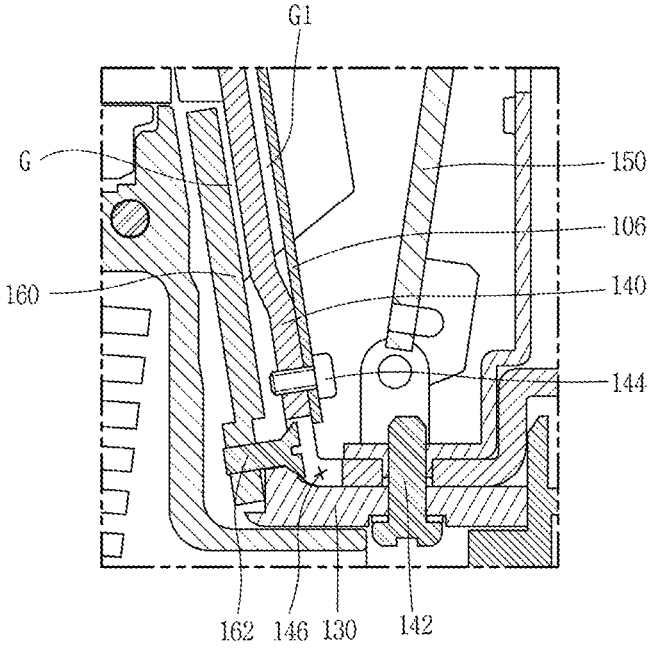
FIG. 4 is an enlarged cross-sectional view illustrating another part of the embodiment illustrated in FIG. 2.

Specifically, a heater 140 for generating heat to deform the bimetal 106 when an overcurrent flows is fixed to an upper surface of the magnet fixing portion 130. Referring to FIG. 4, the heater 140 is immovably fixed to the magnet fixing portion 130 by the heater fixing bolt 142, and a lower end portion of the bimetal 106 is fixed to heater 140 by a bimetal fixing bolt 144. Here, the heater 140 is in a state of being brought into contact with the bimetal 106 at a contact portion adjacent to the bimetal fixing bolt 144, but separated from the bimetal 106 at the remaining portion to form a bimetal-side separating gap (G1).

On the other hand, an armature bar 150 for rotating the crossbar 120 is provided at the right side of the bimetal 106, and a magnet 160 formed of a ferromagnetic substance to generate a magnetic force using a current flowing through the heater 140 in order to pull the armature bar 150 is provided at the left side of the heater 140. The magnet 160 is fixed to the magnet fixing portion 130 by a magnet fixing bolt 162. Moreover, the magnet 160 is merely brought into contact with the magnet fixing bolt 162 and the magnet fixing portion 130 but not brought into contact with other elements in the remaining portion. In particular, a separating gap (G) exists between the heater 140 and the magnet 160, and thus it is seen that the paths of transferring heat generated from the heater directly to the side of the magnet 160 are all cut off.

In order to prevent the magnet fixing bolt 162 from being brought into contact with the heater 140, a bolt accommodating portion 146 is formed at the heater 140 to pass therethrough. The bolt accommodating portion 146 is formed to be larger than the head portion of the magnet fixing bolt 162 in order to not allow the heater 140 to be brought into contact with the magnet fixing bolt 162, and a tool such as a screw driver or the like can be inserted into the side of the magnet fixing bolt.

The operation of the embodiment will be described below. First, heat generation is carried out in the heater 140 when an overcurrent flows, and accordingly, heat is conducted to the bimetal 106 in contact therewith. When the conducted heat reaches a degree sufficient to bend the bimetal, the crossbar 120 is rotated by bending the bimetal 106. As a result, the restraint of the shooter 118 is released to be rotated, and the nail 116 is rotated by the force of the shooter 118 to operate the driving mechanism 114. The driving mechanism 114 is mechanically connected to the moving contact 104 to rotate the moving contact 104, and thus the circuit is open.

During the foregoing process, a path of conducting heat is suppressed between the heater and the magnet due to the existence of the separating gap (G), and thus most of heat generated from the heater is conducted to the bimetal. Accordingly, the bimetal can be correctly operated as designed. In other words, the bimetal can be operated according to the conduction time and conduction current. Of course, though there exists a magnet fixing portion between the heater and the magnet, an amount of heat conducted therethrough is very small since the magnet fixing portion is made of a synthetic resin material.

The bimetal-side separating gap (G1) performs the role of preventing the bimetal from being deformed while the heater is expanded due to heat. In the absence of the bimetal-side separating gap (G1), the expanded heater may push the bimetal to dislocate the position of the bimetal, but the expanded amount of heat can be absorbed since due to the bimetal-side separating gap (G1).

What is claimed is:

1. A circuit breaker comprising:

a heater generating heat due to a conduction current induced by a moving contact of the circuit breaker;

a bimetal deformed due to heat generated by the heater to separate a contact point of the moving contact;

a magnet generating a magnetic force to move an armature bar when a current above a previously set reference current is induced;

a case accommodating the bimetal and magnet, at least part of the case made of a synthetic resin material;

a magnet fixing portion integrally formed in the case and made of a synthetic resin material; and a bimetal fixing bolt fixing the bimetal to the heater, wherein the heater is fixed to the magnet fixing portion by a heater fixing bolt, wherein the magnet is fixed to the magnet fixing portion by a magnet fixing bolt, wherein a separating gap exists between the heater and the magnet, and wherein a bolt accommodation portion is formed at the heater to prevent the magnet fixing bolt from contacting the heater.

2. The circuit breaker of claim 1, further comprising a heater fixing means fixing the heater to the case, wherein the heater fixing bolt is fastened to the magnet fixing portion.

3. The circuit breaker of claim 1, wherein a bimetal-side separating gap exists between the heater and the bimetal.

4. The circuit breaker of claim 3, wherein the separating gap and the bimetal-side separating gap are located on a remaining portion of the circuit breaker excluding a portion where the heater contacts the bimetal.

5. The circuit breaker of claim 1, wherein only one end portion of the magnet is fixed to the magnet fixing portion.

6. The circuit breaker of claim 5, wherein the magnet is spaced apart from the case except where the one end portion fixed to the magnet fixing portion.

7. The circuit breaker of claim 1, wherein an interference avoidance portion for accommodating part of the magnet fixing means is formed at the heater.

* * * * *